US007279043B2

(12) United States Patent
Krägeloh et al.

(10) Patent No.: US 7,279,043 B2
(45) **Date of Patent: *Oct. 9, 2007**

(54) APPLICATION DEVICE

(75) Inventors: Eckart Krägeloh, Heidenheim (DE); Franz Fischer, Heidenheim (DE); Philipp Speidel, Heidenheim (DE); Christoph Henninger, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 107 days.

This patent is subject to a terminal disclaimer.

(21) Appl. No.: 11/037,716

(22) Filed: Jan. 18, 2005

(65) Prior Publication Data

US 2005/0155546 A1 Jul. 21, 2005

Related U.S. Application Data

(63) Continuation of application No. 10/682,003, filed on Oct. 9, 2003, now Pat. No. 6,902,621, which is a continuation of application No. PCT/DE02/01179, filed on Mar. 30, 2002.

(30) Foreign Application Priority Data

Apr. 12, 2001 (DE) ..... 101 18 631

(51) Int. Cl.
*B05C 5/02* (2006.01)

(52) U.S. Cl. ..... 118/302; 118/410; 118/DIG. 4

(58) Field of Classification Search ..... 118/302, 118/410, DIG. 4; 427/356, 358; 425/378.1, 425/144

See application file for complete search history.

(56) References Cited

U.S. PATENT DOCUMENTS

| | | | | |
|---|---|---|---|---|
| 3,151,356 | A * | 10/1964 | Senecal | 425/133.5 |
| 3,302,239 | A * | 2/1967 | Senecal | 425/131.1 |
| 3,690,297 | A | 9/1972 | Dentch et al. | 118/410 |
| 3,698,355 | A | 10/1972 | Heijnis et al. | 118/411 |
| 3,767,346 | A | 10/1973 | Mihalik | 425/378.1 |
| 4,562,095 | A | 12/1985 | Coulon et al. | 427/180 |
| 4,932,353 | A | 6/1990 | Kawata et al. | 118/302 |
| 5,985,030 | A * | 11/1999 | Taylor et al. | 118/325 |
| 6,117,237 | A | 9/2000 | Yapel et al. | 118/410 |
| 6,471,775 | B1 | 10/2002 | Becker et al. | 118/325 |

FOREIGN PATENT DOCUMENTS

| | | | |
|---|---|---|---|
| DE | 10012345 | 9/2001 | |
| EP | 0701022 | 8/1995 | |
| GB | 736747 | 9/1955 | 15/140 |

* cited by examiner

*Primary Examiner*—Laura Edwards
(74) *Attorney, Agent, or Firm*—Taylor & Aust, P.C.

(57) ABSTRACT

An applicator device and method where on the one hand adherence of particles in the dispensing area of the applicator nozzle, and on the other hand a thermal deflection of applicator device components can be prevented, or at least minimized. At least one thermal control channel through which a fluid flows is integrated into at least one of the two nozzle lips of the applicator device. Water or air can be used as temperature controlling fluids.

6 Claims, 2 Drawing Sheets

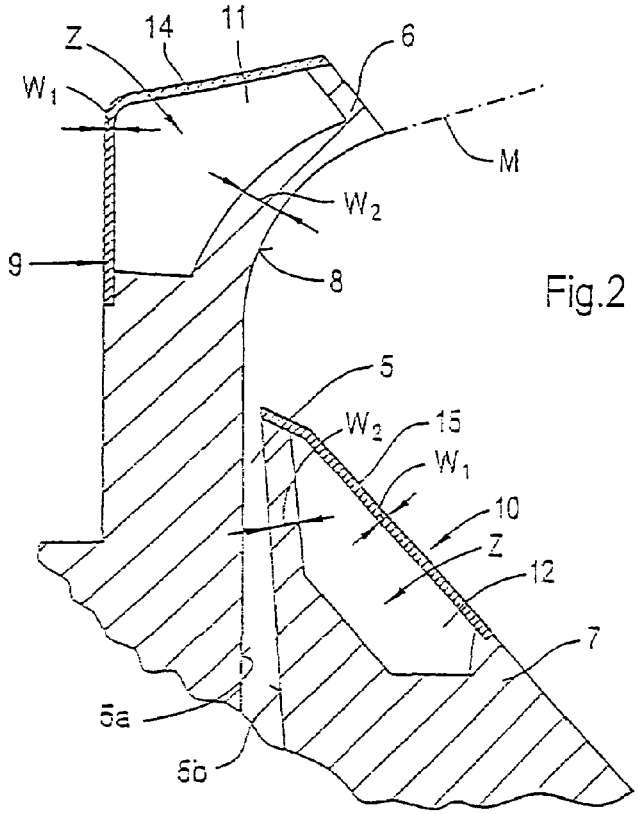
Fig.2
Fig.3
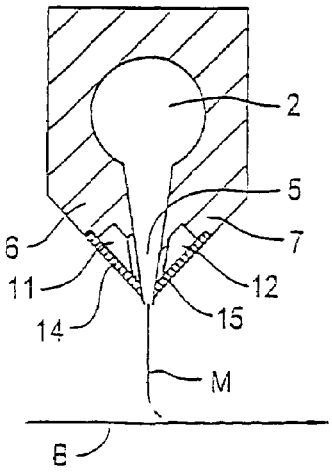
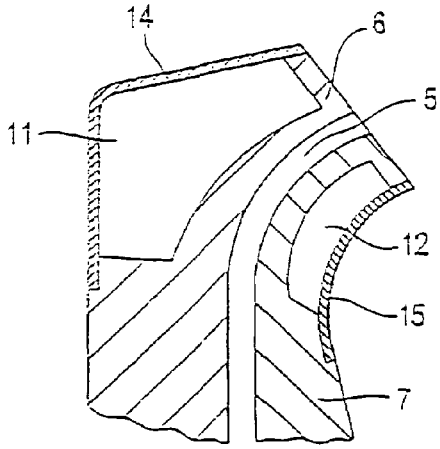
Fig.4

APPLICATION DEVICE

CROSS REFERENCE TO RELATED APPLICATIONS

This application is a continuation of application Ser. No. 10/682,003, filed Oct. 9, 2003, which is now U.S. Pat. No. 6,902,621 having the title APPLICATION DEVICE. U.S. Pat. No. 6,902,621 was a continuation of PCT application No. PCT/DE 02/01179, entitled "APPLICATOR", filed Mar. 30, 2002.

BACKGROUND OF THE INVENTION

1. Field of the Invention

The present invention relates to a device for direct or indirect application of liquid or viscous medium onto a moving material web, especially a paper or cardboard web, and, more particularly, to a metering gap that is formed between an inlet side lip and an outlet side lip of the applicator device.

2. Description of the Related Art

A generic applicator device is known from EP-A 0701022. In this publication a so-called "open-jet nozzle" is disclosed, whereby a free and unsupported stream that is ejected under pressure from the delivery or application nozzle impacts the moving material web directly or indirectly.

An additional generic applicator device is described, for example in publication DE 10012345. This relates to a so-called "Curtain Coater", a curtain-type applicator device, whereby the coating medium reaches the surface that is to be coated, essentially due to gravity.

Both types of applicator devices are equipped with a manifold for the coating medium. From the manifold the medium travels through openings into an inlet gap and from there into the metering gap that is embodied by an applicator nozzle from where the medium subsequently emerges. The metering gap is formed by two nozzle lips. By adjusting one or both lips, the outlet width can be varied.

In direct application of the medium, a material web travels past the delivery nozzle where it is treated directly with the medium. In doing so, the material web travels over at least one supporting surface, for example over a backing roll.

In indirect application of the medium the coating medium is first applied to the surface of an applicator element (for example an applicator roll or a continuous revolving belt) in order to be transferred from the applicator element to the material web in a nip through which the material web travels.

Of the two lips forming the metering gap, the lip that is located on the side of the metering gap on which the material web travels toward the application device is referred to as the inlet side lip. Consequently, the lip that is located on the side of the metering gap on which the material web travels away from the application device is referred to as the outlet side lip.

All these referenced components are full machine width (in other words, extending across the entire width of the paper or cardboard web manufacturing or converting machine). These components are essentially adapted to the width of the web that is to be treated, whereby currently a width of approximately 10 m and more is no longer rare. An additional factor is that with ever increasing demands for higher machine speeds, a uniform application of the medium becomes increasingly more difficult. In addition, long extended components of this type are susceptible to deflection.

Good application results are achieved with nozzle applicator devices of this type. These applicator devices, or their nozzles have however the disadvantage that they are very susceptible to clogging at the delivery area of the machine-wide metering gap. This gap is very narrow and has an opening of only a few millimeters, especially only approximately 0.8 mm. Over a period of time small particles, such as contaminants and particles of the application medium that commonly have a temperature of 60° C. or hotter may adhere to that side of the metering gap that is in contact with the medium and may harden there, so that the application across the entire width of the material web is no longer sufficiently uniform, thereby reducing the coating quality. Because of this, very expensive clean-up procedures are necessary in order to directly remove the deposits ("caking") either mechanically, or through hydraulic means. Often, the machine must even be shut down for this, imposing considerable limits upon machine availability, as well as causing production losses and related high costs.

In some instances attempts are made to cool these areas from the outside. These measures however, are not successful since the cooling effect for the critical area is not sufficient.

SUMMARY OF THE INVENTION

The present invention further advances an applicator device where on the one hand adherence of particles in the dispensing area of the applicator nozzle, and on the other hand a thermal deflection of applicator device components can be prevented, or at least minimized.

The present invention provides at least one thermal control channel through which a fluid flows is integrated into at least one of the two nozzle lips of the applicator device. Water or air can be used as temperature controlling fluids.

A single device according to an embodiment of the present invention therefore provides avoidance or reduction of deposits and "caking" of particles in the critical areas of the application nozzle with a cooling fluid or, if desired, also reduction or prevention of thermal deflection of applicator device components that are responsible for the application results with a fluid whose temperature is adapted to the temperature of the coating medium.

As a rule, the coating medium has a temperature of to approximately 60° C., causing the applicator device, especially the nozzle lips with the metering gap to warm up. The inventors of the present invention recognized that a temperature difference can be produced between outside and inside surfaces of the nozzle lips, when utilizing a cool or cooled fluid. Condensate formation on the surfaces of the metering gap which are in contact with the medium occurs whereby with this formed condensate "caking" of particles is prevented, or at least considerably reduced. The device of the present invention therefore operates in an almost self-cleaning mode, without necessitating machine shut-downs. Even after extended stops, the applicator device is immediately ready for service. Defects in the coating layer are avoided.

If a fluid is utilized that has been adapted to the temperature of the coating medium, thermal deflections are minimized. The selection of either cool or warmed fluid depends upon which advantage of the present invention takes precedence.

It is especially advantageous if the at least one temperature control channel is located in the immediate vicinity of the nozzle end, that is on the outlet end or the delivery area of the device, since this area represents the critical area for "caking".

An advantageous embodiment of the present invention provides that the at least one temperature control channel is located on the side of the nozzle lip (lips) that faces the outside, whereby the wall thickness of the nozzle lip in the area of the temperature control channel is thinner on the side facing the outside than on the side that is in contact with the medium. This has the advantage that the respective nozzle lip in this section is subject to only insignificant thermal deformation.

It is also useful if this outer wall section of the nozzle lip forms a thin-walled component, which additionally seals the temperature control channel toward the outside. The component, for example a strip, needs to be only 0.1 to 3 mm thick, preferably 0.2 to 1 mm.

The metal components, namely the nozzle lip and strip are connected with each other either by laser welding or gluing or brazing. This technology provides a highly precise and tight connection. In addition, an unintentional deformation of the nozzle lips is thereby avoided.

The present inventive device is of simple construction. No other components are required in addition to fluid feed lines that are present in any event in machinery for the production or conversion of a material web, especially a paper or cardboard web, for example for cooling of channels and/or walls. An appropriate diversion of the fluid supply is easily achieved.

Existing nozzle applicator devices, such as open jet nozzles or curtain coater type devices can be easily retrofitted with the present inventive, temperature controllable nozzle lips, if the supporting structure of the applicator device and the nozzle lips are separate components.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 2 is a partial schematic cross-sectional view of another embodiment of the present inventive nozzle lips;

FIG. 3 is a schematic cross-sectional view of an embodiment of the present inventive applicator device in the embodiment of a curtain type applicator nozzle; and FIG. 4 is a partial schematic cross-sectional view of another embodiment of the present inventive nozzle lips.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
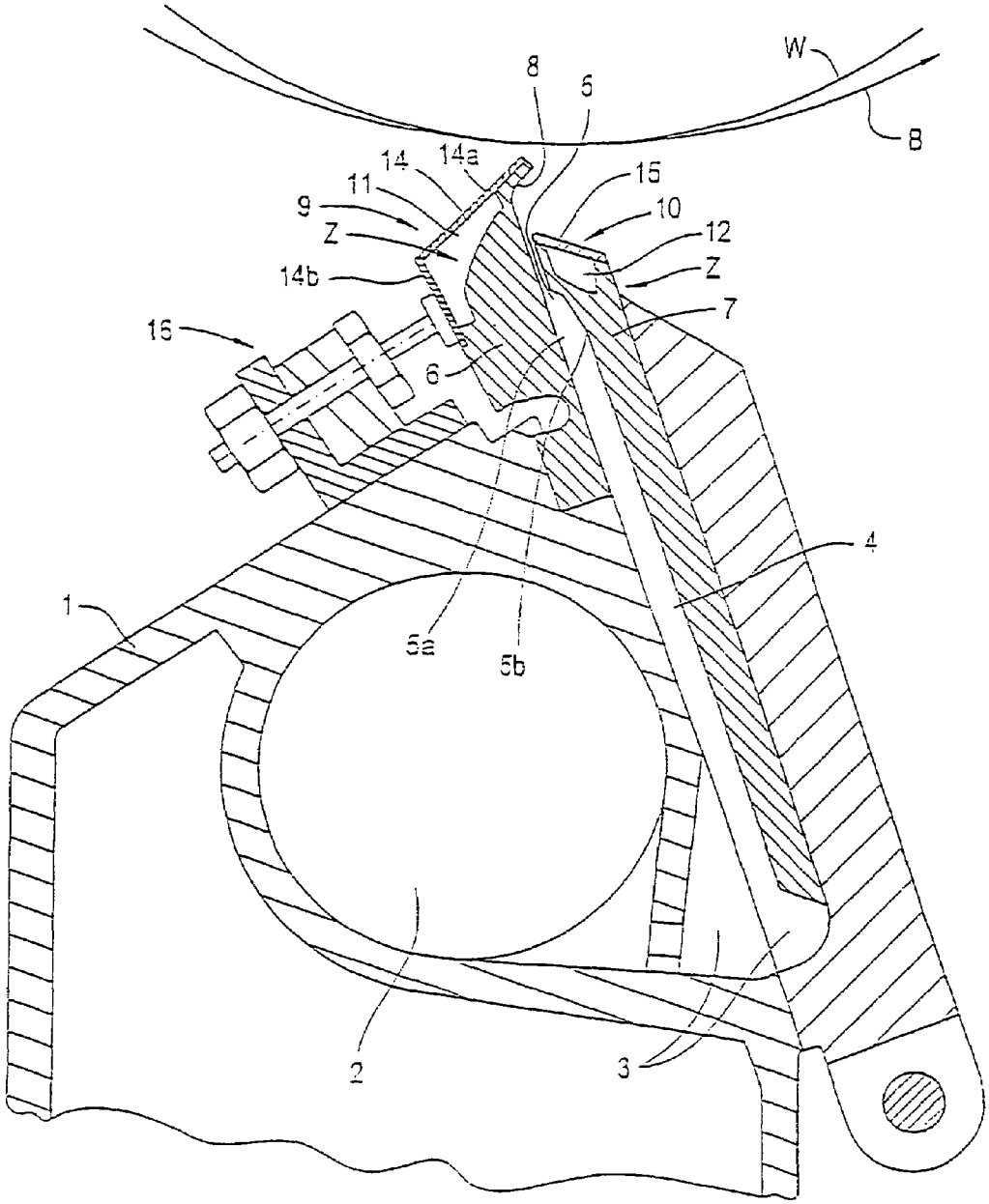
FIG. 1 is an overall schematic cross-sectional view of an embodiment of the present inventive applicator device, in the embodiment of an open jet nozzle.

Referring now to the drawings, and more particularly to FIG. 1, an applicator for coating a moving paper web B generally includes a supporting structure, or support beam 1 that extends across the entire machine width (width of the paper manufacturing or conversion machine, or the width of the applicator device). In the selected example, the paper web travels over a support roll W with the intent of being coated directly with the application medium M.

Support beam 1 includes manifold 2 (so-called ink-manifold) for the liquid or viscous coating medium M, such as pigmented coating ink, glue or starch. Compensating chamber 3 connects to manifold 2, and continues into supply channel 4. Supply channel 4 flows into metering gap 5, that is formed between inlet side lip 6 and outlet side lip 7. Inlet side lip 6 is the side on which the surface (in this instance paper web B) that is to be coated travels toward metering gap 5. Correspondingly, outlet side lip 7 is the one on which the web travels away.

It can be seen in FIG. 1 that for the purpose of degassing the coating medium the free end of inlet side lip 6 extends beyond the free end of outlet side lip 7 and is equipped with a concave curved turning surface 8. Especially in this area, that is in the delivery area of the nozzle or the nozzle tips where the coating medium leaves the nozzles, components of coating medium M, or other impurities may deposit themselves and bake on over a period of time. In order to minimize, or even totally prevent this, at least one temperature control channel or thermal control channel 11 and 12 is provided respectively on the tip of nozzle lips 6 and 7, that is to say on the outlet end, and on sides 9 and 10 facing away from sides 5*a* and 5*b* of metering gap 5 which are in contact with the medium (i.e. on outside 9 of nozzle lip 6 and on outside 10 of nozzle lip 7).

In FIGS. 1-4, only one channel is integrated into the corresponding nozzle lip. An arrangement of individual chambers or parallel channels is also feasible.

As can be seen especially in the detailed illustration in FIG. 2, wall thickness $W_1$ of nozzle lip 6 and 7 in the area of the temperature controlling channels 11 and 12 is thinner on the side facing the outside than wall thickness $W_2$ of the nozzle lips 6 and 7 that face sides 5*a* and 5*b* which is in contact with the medium. This results in almost total elimination of deformation at the nozzle ends. Tests have shown that gap changes (nozzle gap 5) due to thermal stresses at the nozzle ends are only very minimal. For example, at a gap width of 0.8 mm they are less than 5%.

FIG. 2 shows arrows Z which indicate supplies of a fluid such as water or air into the temperature control channels 11 or 12. Depending upon whether the fluid is to be utilized for the prevention of undesired caking (preferred application) or also for the reduction of thermal deflection of the device the decision is made, whether cooling fluid or fluid that is adapted to the temperature of the coating medium is to be utilized. The respectively selected fluid (water or air) can be run through channels 11, 12 in the start-up and/or in the operating phase of the device. If the fluid is used for cooling, it should be colder than the surrounding ambient air.

The aforementioned wall thicknesses $W_1$ are advantageously formed by thin components 14 and 15 so that the entire nozzle lip which is warmed by the coating medium, dryers, etc., can deform thermally only insignificantly when cooling fluid flows through the temperature control channels 11 and 12. Without this construction incorporating thin-walled components 14, 15 these types of deformation would negatively influence the coating results across the width of the material web. This negative influence would further intensify with increasing width of the applicator device.

An additional important principal point of the present invention is therefore: the thinner the component, that is to say the wall thickness is the smaller are the thermal deformations.

From FIG. 1 it can also be seen that component 14 is a two-part component and in this particular variation includes horizontal leg 14*a*, and vertical leg 14*b*. Leg 14*a* at the same time serves as contact point for an already known adjustment device 16 with which the distance between inlet side lip 6 and outlet side lip 7, and thereby the width of the metering gap is adjustable. However, component 14 can of course also be a single part component, as illustrated in FIGS. 2-4.

Sealing of temperature control channels 11, 12 with components 14, 15 is accomplished in this example by a thin 0.7 mm thick strip. The connection with the metallic component of nozzle lips 6, 7 is highly precise. A laser welding process can for example be used for this, especially one utilizing a high efficiency diode laser having a capacity range of 1.2 to 3.0 kW. With a welding seam of this type there is no danger of a heat deformation of the nozzle lip.

The length of the two nozzle lips 6 and 7 can be equal (see FIGS. 3 and 4) or it can be constructed so that inlet side lip 6, as depicted in FIGS. 1 and 2, extends beyond the free end of outlet side lip 7.

FIG. 3 illustrates an applicator device for curtain coating that is constructed similarly to the device according to FIG. 1 and is therefore designated the same references. Nozzle lips 6 and 7 with temperature control channels 11 and 12, as well as the thin outside walls 14 and 15 are located pointing vertically downward and are of equal length. The metering gap 5 that is formed between lips 6 and 7 dispenses the coating medium downward directly onto the material web B (as illustrated in FIG. 3), whereby medium M pours from the nozzle due to gravity.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for one of a direct application and an indirect application of one of a liquid medium and a viscous medium onto a moving material web, said device comprising:

a nozzle including an inlet side nozzle lip and an outlet side nozzle lip;

a metering gap formed between said inlet side nozzle lip and said outlet side nozzle lip, said metering gap for applying the medium therethrough; and at least one thermal control channel through which a thermal control fluid flows, said at least one thermal control channel both in contact with said thermal control fluid and defined at least in part by at least one of said inlet side nozzle lip and said outlet side nozzle lip said at least one thermal control channel having a first wall facing away from said metering gap and a second wall facing said metering gap, said first wall being thinner than said second wall.

2. The device of claim 1, wherein said metering gap includes an outlet end, said metering gap includes a contact side in contact with the medium, at least one of said inlet side nozzle lip and said outlet side nozzle lip includes at least one opposite side that faces away from said contact side, said at least one thermal control channel is located both on said outlet end and on said at least one opposite side.

3. The device of claim 1, wherein said thermal control fluid is one of cooled water, heated water, cooled air and heated air.

4. The device of claim 1, wherein said inlet side nozzle lip and said outlet side nozzle lip form an open jet nozzle that dispenses the medium under pressure.

5. The device of claim 1, wherein said inlet side nozzle lip and said outlet side nozzle lip form a curtain nozzle which dispenses the medium essentially through an influence of gravity.

6. The device of claim 1, wherein said first wall has substantially parallel inner and outer sides, said first wall having a thickness of approximately 0.7 mm.

* * * * *